US007104874B1

(12) United States Patent
Gussack et al.

(10) Patent No.: US 7,104,874 B1
(45) Date of Patent: Sep. 12, 2006

(54) RAZOR SHARPENING APPARATUS

(76) Inventors: Milton Gussack, 335 Edsam Way, Paramus, NJ (US) 07652; Michael Sekerich, 216 N. Pascack Rd., Spring Valley, NY (US) 10977

( * ) Notice: Subject to any disclaimer, the term of this patent is extended or adjusted under 35 U.S.C. 154(b) by 0 days.

(21) Appl. No.: 11/266,941

(22) Filed: Nov. 7, 2005

Related U.S. Application Data

(60) Provisional application No. 60/681,213, filed on May 16, 2005.

(51) Int. Cl.
*B24B 7/00* (2006.01)

(52) U.S. Cl. ..... 451/234; 451/466; 451/496

(58) Field of Classification Search ..... 451/45, 451/59, 234, 466, 496, 498
See application file for complete search history.

(56) References Cited

U.S. PATENT DOCUMENTS

| | | | | |
|---|---|---|---|---|
| 1,859,554 | A | 5/1932 | De Haven | |
| 2,003,007 | A * | 5/1935 | Morgan | 105/1.4 |
| 2,098,465 | A | 11/1937 | Polillo | |
| 2,289,062 | A | 7/1942 | Muros | |
| 2,331,370 | A | 10/1943 | Bowden | |
| 2,458,257 | A | 1/1949 | Donovan | |
| 2,511,188 | A | 6/1950 | Whipple | |
| D162,356 | S | 3/1951 | Smith | |
| 2,565,281 | A | 8/1951 | Thomas | |
| 2,787,921 | A | 4/1957 | Blankenship | |
| 3,057,062 | A | 10/1962 | Mashiba | |
| D211,482 | S | 6/1968 | Kahn | |
| 3,854,251 | A | 12/1974 | Paule | |
| 3,979,857 | A | 9/1976 | Kobylarz | |
| 4,872,292 | A * | 10/1989 | Block | 451/466 |
| 4,974,322 | A | 12/1990 | Butka | |
| 5,036,731 | A | 8/1991 | Fletcher | |
| 5,139,138 | A | 8/1992 | Isaksen | |
| 5,785,586 | A | 7/1998 | Delsignore | |
| 5,944,587 | A * | 8/1999 | Stadtfeld | 451/59 |
| 6,030,281 | A | 2/2000 | Cozzini et al. | |
| D446,883 | S | 8/2001 | Christianson | |
| 6,488,834 | B1 | 12/2002 | Francis | |
| 6,506,106 | B1 | 1/2003 | Fletcher | |
| 6,669,531 | B1 * | 12/2003 | Shaffer | 451/5 |
| 6,969,299 | B1 * | 11/2005 | Papetti | 451/6 |
| 2005/0101231 | A1 | 5/2005 | Sekerich | |

* cited by examiner

*Primary Examiner*—Eileen P. Morgan

(57) ABSTRACT

A sharpening apparatus for razors includes a blade sharpener rotatably supported within a housing and driven by mechanical activation or by a motor. An opening in the housing provides access to the blade sharpener for a blade head of a razor containing one or more blades. The rotatably supported blade sharpener includes at least one flexible sharpening strip on a body, the sharpening strip presenting an abrasive outer surface for contacting the blades. The sharpening apparatus can also include a spring loaded clamping plate for retaining the blade head in the opening.

15 Claims, 4 Drawing Sheets

FIG.1
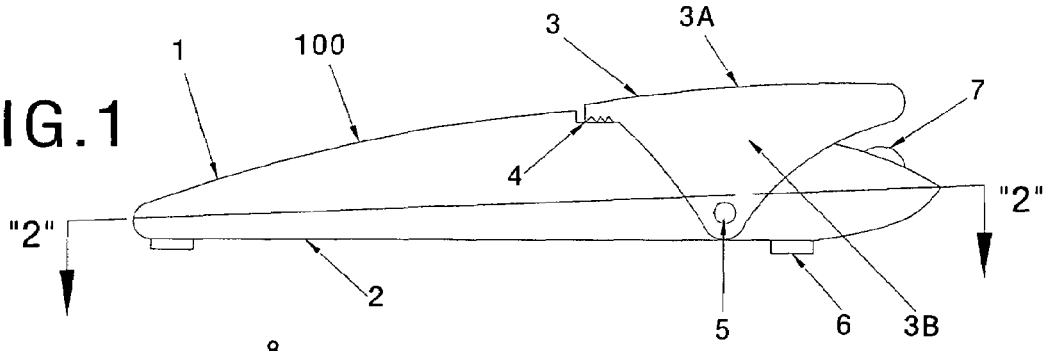
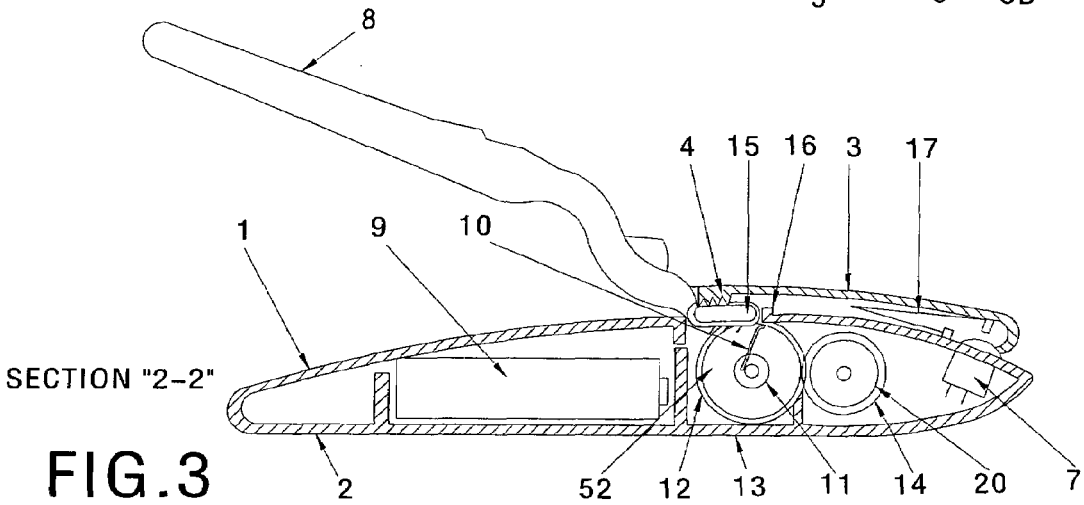
FIG.3
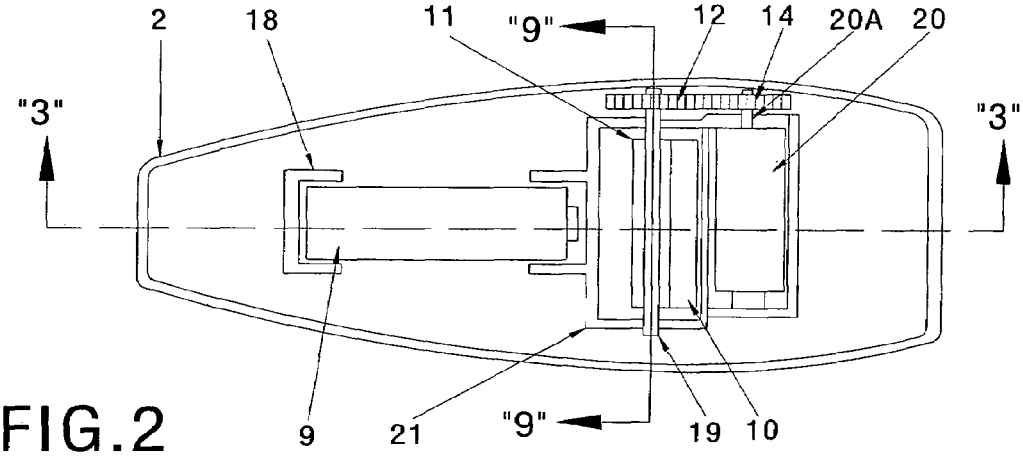
FIG.2

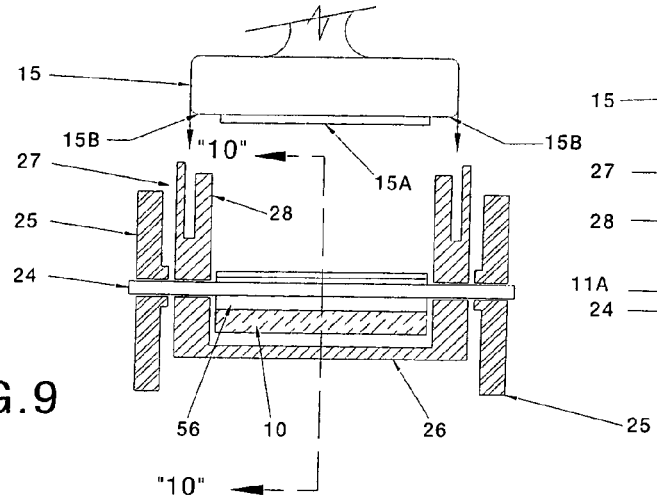
FIG.9
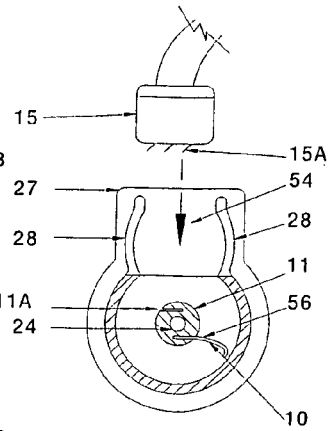
FIG.10
FIG.13
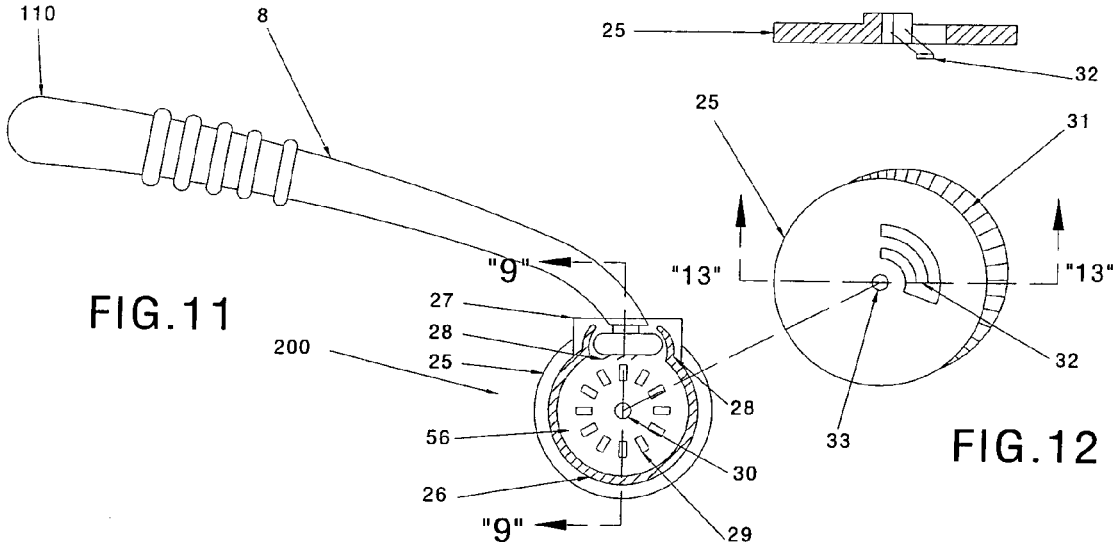
FIG.11
FIG.12

RAZOR SHARPENING APPARATUS

RELATED APPLICATIONS

The present application claims priority of U.S. Provisional application Ser. No. 60/681,213 filed May 16, 2005, the entire disclosure of which is incorporated herein by reference.

FIELD OF THE INVENTION

The present invention relates to a blade sharpening apparatus and, more particularly, to an apparatus for sharpening razors having one or more blades housed in a blade head.

BACKGROUND OF THE INVENTION

Razors having a handle, and one or more blades housed in a head connected or releasably connected to the handle, are used by both men and women for personal shaving needs. The term "razor" as used herein is not limited to handles that are integrally connected to a blade head but rather is intended to include handles that are either integral with or removably attachable to the blade head. Furthermore, the term "blade head" covers integral blade heads or blade cartridges that include one or more blades and which are releasably connected to the handle to permit replacement of the cartridge. The blade sharpener of the present invention, therefore, could be used to sharpen razors having either integral blade heads or replaceable blade cartridges.

While razors are capable of providing multiple shaves, the number of uses of each razor, or blade head, is limited. The cutting edges of the individual razor blades that shear hair, are dulled by use and may become unfit for shaving after only a few uses. Most razors are not equipped with sharpeners. As a result, the razor, or the blade head, must be discarded when its useful life is reached. The life of the average razor, or blade head, is estimated to be approximately three to seven shaves. Assuming a user that shaves daily, approximately seventy razors or blade heads would need to be purchased and discarded annually. This is not only costly, but adds to the environmental burden of discarded plastic, packaging and metal.

Known devices for sharpening blades are shown, for example, in the following U.S. Pat. Nos.:

U.S. Pat. No. 3,854,251 to Paule describes a device wherein the safety razor blade to be sharpened reciprocates between a series of honing elements.

U.S. Pat. No. 3,979,857 to Kobylarz describes a safety razor sharpener wherein an abrasive disc is hand rotated over the blade.

U.S. Pat. No. 4,974,322 to Butka describes a knife that can be sharpened with a hand operated movable casing.

U.S. Pat. No. 5,036,731 to Fletcher describes an apparatus used for the sharpening of a razor blade by hand operation.

U.S. Pat. No. 5,139,138 to Isaksen describes a combination razor assembly for shaving and a container for sharpening the blade manually.

U.S. Pat. No. 5,785,586 to Delsignore describes a method and apparatus for sharpening a blade by polishing it in a slurry.

Other sharpening devices are shown in U.S. Pat. No. 6,030,281 to Cozzini, U.S. Pat. No. 6,488,834 to Francis, U.S. Pat. No. 6,506,106 to Fletcher and U.S. Design patents Des. 162,356, Des. 211,482, and Des. 446,883.

Other known devices are shown in U.S. Pat. Nos. 1,859,554; 2,098,465; 2,331,370; 2,458,257; 2,511,188; 2,565,281; and 3,057,062.

The sharpener disclosed in each of these references has one or more disadvantages. For example, the sharpening action for some of the devices must be provided manually by a user requiring effort and time to achieve the benefit of sharpening. Other known devices that are motor-driven to provide blade sharpening, rely upon an external power source. Such devices lack portability. Some of these devices, in which the external power source is that typically supplied to a household at 120 volts AC, present a potential electrical hazard when the sharpener is used in wet environments. Other known sharpening devices are directed to sharpening razor blades that are intended to be inserted by a user into a blade head. Such devices, therefore, cannot be used to sharpen the razor blades of a razor. Other known sharpening devices are included in combination with shavers, thereby adding weight to the shaver and resulting in a less ergonomic design.

SUMMARY OF THE INVENTION

The present invention provides an apparatus for sharpening the blades of a razor. The razor includes a blade head in which the blades are retained and a handle connected to the blade head for manipulating the blade head. The sharpening apparatus comprises a housing defining an interior space and an opening adapted to receive the blade head of a razor. The apparatus also includes a blade sharpener located within the housing adjacent to the opening. The blade sharpener is rotatably supported for rotation about an axis and includes at least one flexible sharpening strip having an abrasive surface arranged for sweeping over the blades of the blade head. The apparatus further includes a drive mechanism, such as a motor, operably connected to the blade sharpener to rotate the blade sharpener about the axis.

BRIEF DESCRIPTION OF THE DRAWINGS

For the purpose of illustrating the invention, there are shown in the drawings several embodiments that are presently preferred.

FIG. 1 is a side elevation view of one embodiment of the sharpening apparatus of this invention;

FIG. 2 is a sectional view taken along line 2—2 of FIG. 1;

FIG. 3 is a sectional view taken along line 3—3 of FIG. 2 of the sharpening apparatus of this invention showing a razor seated in the sharpening apparatus prior to sharpening;

FIG. 9 is a sectional view of another embodiment of this invention taken along line 9—9 of FIG. 11 prior to placement of the razor head therein;

FIG. 10 is a partial sectional view taken along line 10—10 of FIG. 9 prior to placement of the razor head therein;

FIG. 11 is a partial sectional view taken along line 10—10 of FIG. 9 with the razor head inserted in the sharpener;

FIG. 12 is the drive wheel for the sharpener apparatus of this invention;

FIG. 13 is a sectional view taken along line 13—13 of FIG. 12;

DETAILED DESCRIPTION OF THE INVENTION

Figure 4:
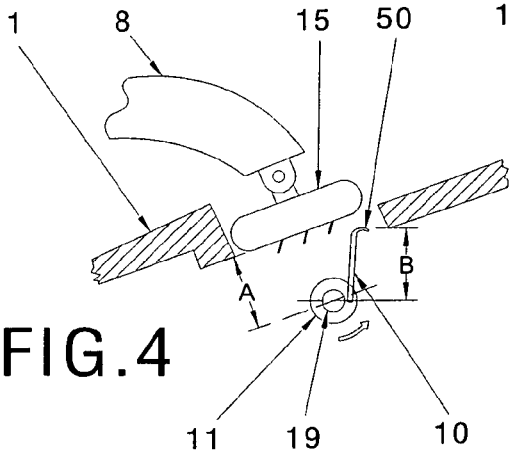
FIG. 4 is a partial side view of the sharpening apparatus of this invention shown with the blades of a razor contacting the blade sharpener.
Figure 5:
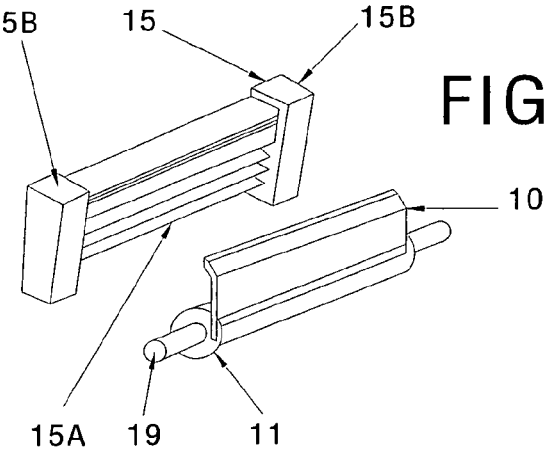
FIG. 5 is a perspective view of the blade sharpener and razor, the razor shown without its handle.
Figure 6:
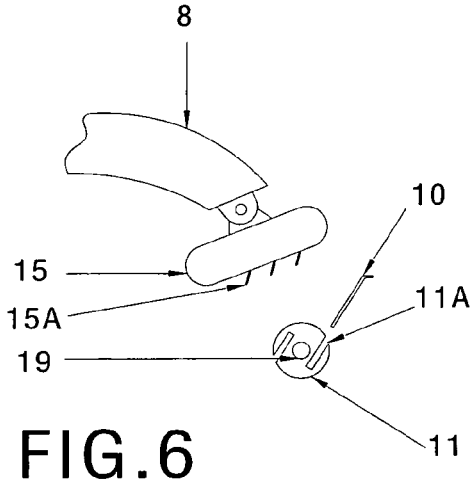
FIG. 6 is a partial side view of a sharpening apparatus of this invention showing the blades of a razor and the blade sharpener.

Referring to the drawings, where like numerals refer to like elements, there is shown in FIGS. 1–8 and 14, one embodiment of an apparatus 100 according to the invention, for sharpening a razor 110. Referring to FIGS. 3, 4 and 6, a typical razor 110 used with this invention comprises a handle 8 connected to the shaver cartridge or blade head 15. The blade head 15 can house one or more blades 15*a*. The handle 8 is used to facilitate manipulation of the blade head 15. Such razors 110 are well known and used by millions of people to shave typically, the face, underarms and legs.

The sharpening apparatus 100 includes an upper housing 1 on which the razor 110 is seated, see FIG. 3, and a lower housing 2 which rests upon a surface, e.g., sink surface. As shown in FIG. 1, the lower housing 2 may have feet 6 which elevate the device 100 above the sink surface to provide protection from water that can coat the sink and to provide a stable, cushioned footing for the sharpener 100. The lower housing 1 has on the bottom thereof vents or drains 13 to permit any water and debris to pass through or drain from the apparatus and permit the rinsing of the device.

The sharpening apparatus 100 of this invention increases the useful life of the shaver cartridge or blades 15 in an efficient, clean, and inexpensive manner. Typically a razor 110 lasts for three to seven shaves (of a face) if not sharpened. The sharpening apparatus 100 of this invention can extend the life of such razor 110 substantially, and depending on the use to which the razor 110 is put, almost indefinitely, for example up to one hundred times the ordinary life of such razor 110.

Referring to FIGS. 4–6, the razor cartridge 15 includes one or more blades 15*a* secured in the cartridge 15. The razor 110 is shown in FIG. 5 without the handle 8 and with the blade head 15 exposed for clarity of view. The blade head 15 can be either integral with the razor handle 8 or can be a blade cartridge 15 that is adapted to releasably attached to the razor handle 8. As such, the term "razor" includes devices with blade heads 15 that are either integral with or releasably attached to the handle 8. The blade sharpener 100 of the present invention, therefore, can be used to sharpen razors 110 having either integral blade heads or replaceable blade cartridges.

Referring to FIGS. 1–3, the housing comprises an upper housing 1 and a lower housing or base 2. The upper and lower housings 1,2 may be releasably attached to each other to provide access to the interior of the housing to permit maintenance thereof, e.g., a change of battery 9. The housings 1,2 define an interior space in which a sharpening mechanism, generally 120, is contained. Preferably, the housings 1,2 are constructed from a polymeric or plastic material. The use of a plastic material for the housings facilitates easy manufacture and provides for a lightweight, durable, structure.

As shown more clearly in FIGS. 2, 3, 4 and 8, the upper housing 1 includes an opening 50 in the shaver head 15 enclosure 21 formed in the top thereof. The opening 50 is dimensioned for receipt of the blade head 15 of razor 110 to provide access to the sharpening mechanism 110 contained within the housings 1,2 for sharpening of the blades 15*a*. The opening 50 is of a size and shape that can accommodate numerous types and sizes of razor heads. Preferably, the opening 50 is substantially rectangular to accommodate the blade head 15 that is generally rectangular in configuration. The shape of the opening 50, however, need not be a true rectangle and could have other shapes. For example, the opening 50 could include rounded ends to facilitate manufacture and be oversized to accommodate different sized razor heads 15. The opening further includes a locking rib 16 around at least a portion of the opening 50 to assist in locking the razor head 15 therein.

Figure 8:
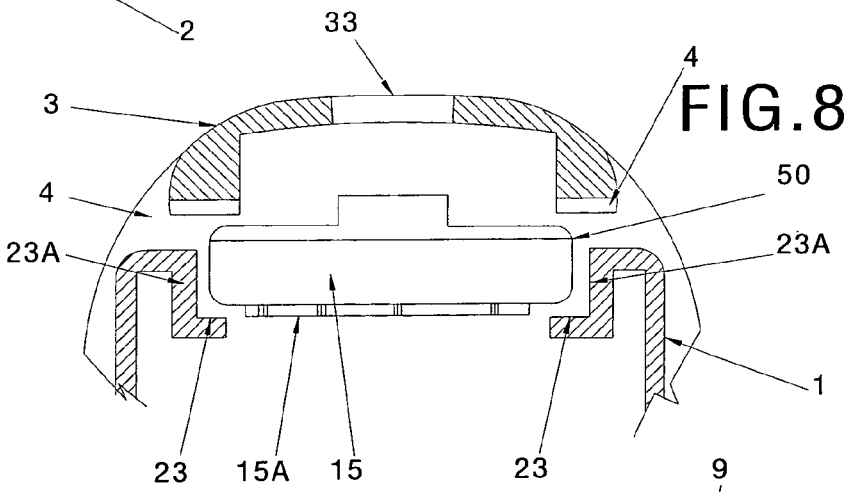
FIG. 8 is a partial sectional view taken along line 8—8 of FIG. 7.
Figure 14:
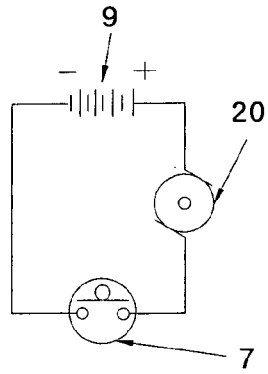
FIG. 14 is an electrical schematic of the activating switch used to drive the sharpener shown in FIGS. 1–8.

Referring to FIG. 8, the upper housing 1 preferably includes a razor head guide 23 located in the opening 50 having substantially upstanding walls 23*a* that surround the opening 50. The upstanding walls 23*a* of the head guide 23 function to retain the shaver cartridge head 15 of razor 110 and position the head 15 with respect to the opening 50 in the upper housing 1.

As shown in FIGS. 1–3 and 7, the housings 1, 2 are preferably elongated to include a tail portion 2*a* that can provide support for the handle 8 of razor 110. The elongated shape for the housings also facilitates ergonomic handling of the sharpener 100.

Referring to FIGS. 1–6, the sharpening mechanism 52, which is located within the interior space of the housings 1, 2, includes a hub 11 which is rotatingly supported on shaft 19, preferably both of which are cylindrical. As shown in FIGS. 4–6, the hub 19 has at least one axial slot 11*a* therein, and as depicted two slots 11*a*. Removably inserted or mounted in at least one of these slots 11*a* is a flexible sharpening member or flap 10. The sharpening flap 10 can be a sandpaper or other type of flexible member having at least one side of which that is abrasive and suitable for sharpening razor type blades 15*a*, such as silicon carbide, aluminum oxide, ceramics or any other suitable material which provide a sufficiently abrasive surface. In the embodiment depicted there are two slots 11*a* and one sharpening flap 10. The hub 19 may have any number of such slots 11*a* and sharpening flaps 10 and is dependant on the flap grit, speed of operation and other parameters. However, two slots 11*a* and one sharpening flap 10 are preferred by the inventor.

Preferably, as depicted in FIGS. 3–6, the hub 11, shaft 19, slots 11*a* are parallel to the blades 15*a* such that the sharpening flap 10 when inserted therein is also parallel thereto. It is possible to have these elements angulated to the blades 15*a*, however this presents an unnecessarily complex device. Referring to FIG. 4, the sharpening flap is of a length B that when inserted in a slot 11*a* a portion of the length of the flap 10 sweeps across all of the blades 15*a* when rotated in (as shown) in a counterclockwise direction. Referring to FIG. 4, the length B of the sharpening flap 10 is greater than the distance A between the centerline of rotation of the flap 10 and the head 15 to facilitate flap 10 sweeping across the blades 15*a*.

Still referring to FIGS. 4–6, the sharpening flap 10 preferably has an axial length that is approximately equal to the length of the cutting edges of the razor blades 15*a*. As a result, the abrasive side of the sharpening flap 10 engages only the blades 15*a* and not the shaver cartridge ends 15*b* of the cartridge 15.

Referring, for example to FIGS. 2 and 3, the shaft 19 of the blade sharpener mechanism 52 is rotatably supported in the housings 1,2 at either end. The opposite ends of the shaft 19 are supported on upstanding walls (not shown) within the interior space of the housings 1,2. As shown in FIGS. 3, 4 and 8, the blade sharpener 52 is located adjacent the opening 50 of housing 1 such that, the abrasive surface of the sharpening flap 10 sweeps across the blades 15*a* of blade head 15 when the razor 110 is seated on the housing 1. As shown, the blade sharpener 52 is supported within the housings 1, 2 such that the cutting edges of the blades 15*a* extend substantially parallel to the axis of rotation of the hub 11 of the blade sharpener 52.

The amount of sharpening that is required will depend on multiple factors, including the dullness of the blades 15*a*, the material composition of the blades, the material composition of the abrasive body of the sharpening flap 10 and the speed of rotation of the hub 11. However, it is anticipated that blade sharpening will occur in about three to five seconds.

The sharpening mechanism 52 further includes a drive mechanism or system to rotate the shaft 19, hub 11 mounted thereto and associated sharpening flap 10. In the embodiment depicted in the Figures, particularly FIGS. 2 and 3, the drive system includes a motor 20 having a rotatingly driven output shaft 20*a* and a first or driver gear 14 connected to the output shaft 20*a* of the motor 20 for rotation therewith. Preferably, the motor is a DC motor. The drive system further includes a second or driven gear 12 connected to an end of the shaft 19 for rotation therewith. Each of the gears 12, 14 includes teeth formed about an outer periphery. As shown in FIGS. 2 and 3, the motor 20 is mounted within the housings 1,2 substantially parallel to the blade sharpener shaft 19, and offset therefrom, such that the teeth of the gears 12, 14 meshingly engage each other to transfer rotation of the output shaft of motor 20 to rotation of the shaft 19, and the sharpening flap 10 thereon. Other means for transferring rotation between the motor 20 and the shaft 19 can be used instead of a geared system, such as a belts, pulleys and/or rollers.

The sharpening mechanism 52 includes at least one battery 9 mounted within the housings 1, 2 between a battery holder 18 and the enclosure 21 to provide an internal power source for the motor 20. The battery 9 may be a conventional disposable battery, or may be a rechargeable battery. If the battery 9 is rechargeable, conventional electrical connections between the battery and an external power source, such as an A/C outlet, would preferably also be included. A removable cover or access panel may be formed in the housing at the location of the battery 9.

It is also within the scope of the invention that the razor sharpening apparatus 100 could be constructed for disposal following depletion of the internal power source. For such a disposable apparatus, no access to the internal power source would be required. It is also contemplated that the apparatus could be constructed without an internal power source and, instead, be adapted for connection to a source of power located externally of the housings 1,2.

Figure 7:
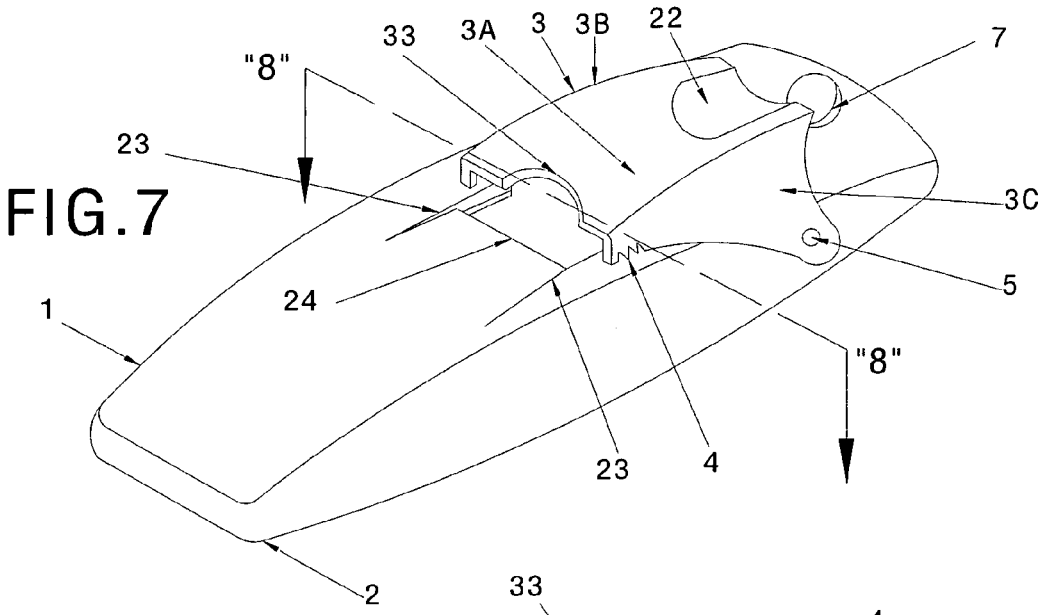
FIG. 7 is a perspective view of the sharpening apparatus of this invention.

The sharpening apparatus 100 also includes an activation switch 7 extending from the top of the housing 1 and preferably on the front end of the apparatus 100, see FIGS. 1, 2 and 7, for actuation of the sharpener by a user. When the switch 7 is actuated by a user, power is supplied to the motor 20 causing the motor 20 to rotate the shaft 19 on which the hub 11 and sharpening flap 10 is mounted. It is also contemplated that the motor may be automatically activated upon sensing of a razor 110 or a blade head 15. For example, an optical or pressure sensor may be located near the opening 50 for sensing when a blade head 15 is located within the opening. A signal would be provided to activate the motor and rotation of the sharpener mechanism. Alternatively, a pressure sensor could be located within the recess for sensing when the handle 8 of the razor 110 is seated in the recess. Again, a signal would be sent to the motor to activate it. Those skilled in the art would be readily capable of incorporating these and other mechanisms for automatically activating the motor into the present invention. Upon activation, the device may be configured with conventional circuitry to operate for a predetermined period of time, e.g., 3 seconds.

Referring to FIGS. 1, 3, 7 and 8, the apparatus 100 of this invention is further provided with a spring activated clamping plate 3. The clamping plate comprises a top portion 3*a* and side portions 3*b* and 3*c*. As shown in FIGS. 1 and 7, the side portions 3*b* and 3*c* are pivotally attached to the sides of the lower housing 2, although they could be attached to the upper housing 1, through pivot pins 5. This enables the clamping plate 3 to be pivoted between a first position (FIG. 1) and a second position (FIG. 3). The top portion 3*a* is adapted to cover the shaver head 15 when inserted in opening 50.

Referring to FIG. 3, the clamping plate 3 is spring activated to maintain the clamping plate in the first position (FIG. 1). Referring to FIG. 7, when the clamping plate 3 finger depression 22 is pressed, the clamping plate 3 pivots into the second position, permitting the shaver cartridge head 15 to be positioned in opening 50. When the pressure on finger depression 22 is released, the spring means, e.g. leaf spring 17, forces clamping plate 3 onto the shaver head 15 to thereby securely maintain the razor head 15 in opening 50 for subsequent sharpening. Underlying the upper portion of the clamping plate 3*a* is gripping surface 4 to assist in maintaining the shaver cartridge 15 in opening 50. After the shaver head 15 is in position, the activation switch 7 is pressed to commence sharpening. The present invention is not limited to any particular switch and any suitable switch could be used, such as a slide switch.

This embodiment of the invention has many advantages, including achievement of electrically powered sharpening of razors. The razor sharpening apparatus described herein is also lightweight and includes relatively inexpensive components. It will be appreciated that the incorporation of an internal battery power of the razor sharpening apparatus permits the apparatus to be used in any location. Additionally, if used within a wet environment, the battery power does not present an electrical hazard to the user. However, it should be recognized that the present invention is not limited to the preferred use of batteries. On the contrary, a conventional electrical cord may be used to provide power to the device.

FIGS. 9–13 depict another embodiment of this invention, in particular a hand operated razor sharpening apparatus, i.e., non-electrical. In this embodiment similar elements have the same numbers as the prior embodiment. The apparatus 200 comprises a housing 26 having rotatably mounted thereto a driver wheel 25 on each side of the housing 26. The housing 26 includes an opening 54 surrounded by guide walls 27. The opening 54 is dimensioned for receipt of the blade head 15 of razor 110 to provide access to the sharpening mechanism 56 contained within the housing for sharpening of the blades 15*a*. Preferably, the opening 54 is substantially rectangular to accommodate the blade head 15. The opening further includes a pair of spring locking tabs 28 around at least a portion of the opening 54 to assist in locking the razor head 15 therein. The opening 54 is of a size that can accommodate numerous types and sizes of razor heads.

Referring to FIGS. 9–12, the sharpening mechanism 56, which is located within the interior of the housing 26, includes a hub 11 which is rotatingly supported on shaft 24, preferably both of which are cylindrical. As shown in FIGS. 10, the hub 11 has at least one axial slot 11*a* therein, and as depicted two slots 11*a*. Removably inserted or mounted in at least one of these slots 11*a*, and preferably both for this hand operated device, is a flexible sharpening member or flap 10. As in the previous embodiment, the sharpening flap 10 can be a sandpaper or other type of flexible member having at least one side of which that is abrasive and suitable for sharpening razor type blades 15*a*. As with the other embodiment, hub 19 may have any number of such slots 11*a* and sharpening flaps 10. However, two slots 11*a* and two sharpening flaps 10 are preferred. Preferably, hub 11, axle 54, and slots 11*a* are parallel to the blades 15*a* such that the sharpening flaps 10 when inserted therein are also parallel thereto. Referring to FIG. 10, the sharpening flaps 10 are of a length that when inserted in the slots 11*a* a portion of the length of the flap 10 sweeps across all of the blades 15*a* when rotated in (as shown) in a counterclockwise direction.

As shown in FIG. 9, the sharpening flap 10 preferably has an axial length that is approximately equal to the length of the cutting edges of the razor blades 15*a*. As a result, the abrasive side of the sharpening flap 10 engages only the blades 15*a* and not the shaver cartridge ends 15*b* of the cartridge 15.

Referring to FIGS. 9 and 10, the axle 24 of the blade sharpener mechanism 56 is rotatably supported in the housing 26 at either end and project therefrom. Driver wheels 25 are fixedly attached to each end of the axle 58. Each driver wheel 25 can have a gripping surface 31 on the outer periphery to permit it to grip the surface it is rolled on. Referring to FIGS. 11–13, at least one driver wheel 25 may be provided with a detent means for permitting rotation of the wheels 25 in one direction and prohibiting rotation of the wheels 25 in the other direction. For example, as depicted, the wheel has on it a spring loaded detent 32 that when rotated in the correct direction for sharpening (in this case counterclockwise) slides over a stationary perforate hub 60. When rotated in the opposite direction (not suitable for sharpening), the spring loaded detent 32 snaps into a perforation 29 to prevent or at least inhibit improper rotation of the drive wheels 25.

In order to use the sharpener 200 the razor head 15 is positioned in the opening 54 and snapped into the spring locking tabs 28. The handle 8 is then gripped and the sharpener 200 rolled on a surface. The drive wheels drive the axle 24, hub 11 and sharpening flaps 10 to sharpen the blades 15*a*.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. An apparatus for sharpening the cutting edge of one or more blades of a blade head of a razor, the apparatus comprising:

a housing defining an interior space and an opening adapted to receive the blade head of a razor;

a blade sharpener located within the housing adjacent to the opening, the blade sharpener rotatably supported for rotation about an axis, the blade sharpener including a hub rotatable about the axis and at least one flexible sharpening strip mounted to the hub, the flexible strip having an abrasive surface arranged for contact with at least one blade of a razor, a first end and a second opposite end, the first end of the strip mounted to the hub and the second end projecting freely therefrom;

and a drive mechanics operably connected to the blade sharpener to rotate the blade sharpener about the axis, wherein the flexible strip is rotated about the axis and sweeps across the blade.

2. The sharpening apparatus according to claim 1, wherein the blade sharpener includes support shaft extending out from the hub the support shaft being supported in the housing so as to be rotatable about the axis.

3. The sharpening apparatus according to claim 1, wherein the sharpening strip has a portion of the surface covered with an abrasive material.

4. The sharpening apparatus according to claim 2, wherein the drive mechanism includes a motor with an output shaft substantially parallel to the blade sharpener support shaft and offset therefrom, the further comprising first and second gears respectively connected to the motor output shaft and the blade sharpener support shaft, each of the first and second gears having teeth formed about an outer periphery, the teeth of the first and second gears meshingly engaging each other to transfer rotation of the motor output shaft to rotation of the blade sharpener support shaft during operation.

5. The sharpening apparatus according to claim 1, further including a power source for the drive mechanism located within housing.

6. The sharpening apparatus according to claim 5, wherein the power source comprises at least one battery mounted within the housing.

7. The sharpening apparatus according to claim 1, wherein the housing includes side walls and a top, the opening being located in the top of the housing, and wherein the top of the housing provides for seated receipt of a razor when the blade head of the razor is received by the opening and a spring loaded clamping plate for retaining the blade head in the opening.

8. The sharpening apparatus according to claim 1 further comprising a switch mounted within the housing for selective actuation of the drive mechanism by a user of the apparatus.

9. The sharpening apparatus according to claim 1 further comprising a sensor for detecting the presence of a blade head within the opening, the sensor sending a signal to activate the drive mechanism when a blade head is detected within the opening.

10. The sharpening apparatus according to claim 1 wherein the drive mechanism operates for a predetermined period of time when activated.

11. The sharpening apparatus according to claim 1, wherein the sharpening strip is of sufficient length to sweep across all the blades of the razor.

12. The sharpening apparatus according to claim 1, wherein sharpening strip is removably mounted to the hub.

13. An apparatus for sharpening the cutting edge of one or more blades of a blade head of a razor, the razor including a handle connected to the blade head for manipulating the blade head, the apparatus comprising:

a housing defining an interior space and including side walls, a top and a bottom, the top of the housing including an opening adapted to receive the blade head of a razor, a blade sharpener located within the housing adjacent the opening, the blade sharpener including a carrier body having a support shaft extending out from the carrier body, the blade sharpener support shaft being supported by the housing for rotation of the carrier body about an axis, each end of the shaft projecting from the housing;

the blade sharpener further including a plurality of flexible abrasive strips each received in a longitudinally extending channel formed in the carrier body, the abrasive strips and the carrier body channels respectively dimensioned such that a portion of each of the abrasive strips extends radially outward from the carrier body for contact with at least one blade of a razor when the rod is disposed within the channel;

a drive wheel fixedly mounted to each end of the support shaft, whereby when the handle is pushed in one direction while the drive wheels are on a surface, the support shaft rotates the blade sharpener to sharpen the blades.

14. The sharpening apparatus according to claim 13, wherein at least one drive wheel includes a detent means for preventing rotation of the wheel in a direction opposite the one direction.

15. The sharpening apparatus according to claim 13, wherein the sharpening strips are of sufficient length to sweep across all the blades of the razor.

* * * * *